310-800 SR
7/14/81 XR 4,278,000

United States Patent [19] [11] 4,278,000
Saito et al. [45] Jul. 14, 1981

[54] PIEZOELECTRIC TRANSDUCER FOR ELECTRICAL STRING INSTRUMENTS AND PICKUP MEANS COMPRISING THE SAME

[75] Inventors: Shigeo Saito; Tsutomu Tsunooka, both of Nagoya, Japan

[73] Assignee: NGK Spark Plug Co., Ltd., Nagoya, Japan

[21] Appl. No.: 88,622

[22] Filed: Oct. 26, 1979

[30] Foreign Application Priority Data

Nov. 5, 1978 [JP] Japan ..... 53/136027

[51] Int. Cl.[3] ..... G10H 3/18
[52] U.S. Cl. ..... 84/1.16; 84/DIG. 24; 310/328; 310/369; 310/800
[58] Field of Search ..... 84/1.04, 1.06, 1.14, 84/1.16, DIG. 24; 310/330–333, 340, 358, 363, 365, 800, 328, 369

[56] References Cited

U.S. PATENT DOCUMENTS

| | | | |
|---|---|---|---|
| 2,769,867 | 11/1956 | Crownover et al. | 84/DIG. 24 |
| 3,396,284 | 8/1968 | Scherer | 84/DIG. 24 |
| 3,519,721 | 7/1970 | Martin et al. | 84/1.14 |
| 3,712,951 | 1/1973 | Rickard | 84/1.14 |
| 3,750,127 | 7/1973 | Ayers et al. | 310/330 X |
| 3,798,474 | 3/1974 | Cassand et al. | 310/331 |
| 3,820,208 | 6/1974 | Baldy | 310/358 X |
| 4,183,010 | 1/1980 | Miller | 310/800 X |

*Primary Examiner*—Stanley J. Witkowski
*Attorney, Agent, or Firm*—Frishauf, Holtz, Goodman & Woodward

[57] ABSTRACT

The present invention provides a piezoelectric transducer and pickup means using the same for electrical string instruments, the transducer comprising a long and flat outer layer of flexible material and a flexible piezoelectric cable which is buried therein and has a center electrode, a piezoelectric layer formed on the outer periphery of the said electrode and an outer electrode formed on the outer periphery of the said layer, the stiffness thereof being enhanced by either using elastomer of the hardness of more than 80 as measured by the Spring Hardness Test Method in the Physical Testing Method for Vulcanizing Rubber of Japanese Industrial Standard (JIS K 6301) as the material for the outer layer, or by plaiting (braiding) metal wires or by winding the outer electrode of the piezoelectric cable in such a manner as to enable it to press against the piezoelectric layer.

13 Claims, 16 Drawing Figures

PIEZOELECTRIC TRANSDUCER FOR ELECTRICAL STRING INSTRUMENTS AND PICKUP MEANS COMPRISING THE SAME

FIELD OF THE INVENTION

The present invention relates to a piezoelectric transducer and a pickup means which incorporates said transducer. More particularly, it relates to a piezoelectric transducer for electrical string instruments comprising a long and flat outer layer of flexible material wherein flexible piezoelectric cables are buried and a pickup means for electrical string instruments which incorporates said transducer to convert vibration of a plurality of strings into electrical signals.

DESCRIPTION OF THE PRIOR ART

Generally, electrical string instruments such as an electropiano are played by converting the oscillations of a plurality of strings stretched over a frame into electrical signals by means of piezoelectric transducers of piezoelectric body of ceramic material which are provided, together with acoustic insulators, for each of the strings and by introducing amplified signals to a loudspeaker to produce tonal output.

As the conventional piezoelectric members are made by molding and sintering piezoelectric body into a predetermined shape, they lack in mechanical strength and are easily damaged during use. It is not possible to separate vibrations of each individual string because they are a kind of rigid body, nor is it possible to detect vibrations of each string except in a multiple state rendering the separation of notes inadequate. It has therefore been a common practice to install a plurality of small piezoelectric transducers for each of the strings.

BRIEF SUMMARY OF THE INVENTION

The present invention obviates the above mentioned problems in conventional transducers by using a piezoelectric transducer made of piezoelectric materials of polymers or polymer composites which are more tough and superior in processability, as compared to conventional materials.

An object of the present invention is to provide a flexible piezoelectric transducer in a form of a strip.

Another object of the present invention is to provide a piezoelectric transducer capable of converting the mechanical oscillations of strings into a plurality of electrical signals.

Still another object of the present invention is to provide a pickup means for electrical string instruments which is so constructed as to convert mechanical oscillations of a plurality of strings into electrical signals by means of said piezoelectric transducer.

The present invention concerns a piezoelectric transducer and a pickup means incorporating said transducer, the transducer comprising a long and flat outer layer of flexible material and a flexible piezoelectric cable which is buried therein and has a center electrode, a piezoelectric layer formed on the outer periphery of the said electrode and an outer electrode formed on the outer periphery of the said layer, the stiffness of the piezoelectric transducer being enhanced by using elastomer of the hardness of not less than 80 as measured by the Spring Hardness Test Method in the Physical Testing Method for Vulcanizing Rubber of Japanese Industrial Standard (JIS K 6301); other hardness values hereinafter appearing being similarly measured as the material for the outer layer or by plaiting (braiding) metal wires or by winding the outer electrode of the cable in such a manner as to press against the piezoelectric layer.

BRIEF DESCRIPTION OF THE DRAWINGS

FIGS. 6A and 6B show a plurality of piezoelectric transducers of FIG. 1 arranged in longitudinal alignment and integrally bonded by means of an adhesive or the like.

DETAILED DESCRIPTION OF THE INVENTION

Figure 1:
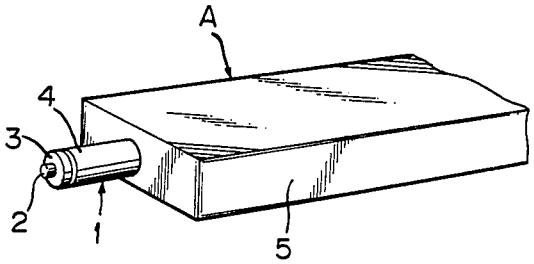
FIG. 1 illustrates a partial oblique view of a piezoelectric transducer representing an embodiment of the first invention of this application.

As for piezoelectric materials to form a flexible piezoelectric layer of the piezoelectric transducer according to the present invention, there are proposed flexible polymer piezoelectric materials such as polyvinylidenefluoride (PVDF), polyvinyl fluoride, etc., or piezoelectric materials of polymer composite obtained by mixing flexible polymer materials of natural or synthetic rubbers such as natural rubber, fluoro rubber, butyl rubber, urethane rubber, silicone rubber, chloroprene rubber, etc., or of synthetic resin such as PVDF, etc. with ferroelectric powder such as barium titanate ($BaTiO_3$), lead titanate ($PbTiO_3$), solid solution of lead titanate-lead zirconate ($PbTiO_3$-$PbZrO_3$) and the like. It is preferable to prepare the piezoelectric materials of polymer composite for use in the present invention by mixing 55 to 60 parts in volume of ferroelectric powder with 45 to 40 volume parts of flexible polymer materials.

Piezoelectric cables using piezoelectric materials of polymer composite of the present invention are prepared, for example, by the following steps: A flexible polymer material such as natural rubber, fluoro rubber, butyl rubber, urethane rubber, silicone rubber or the like is melted to which is added ferroelectric powder such as $BaTiO_3$, $PbTiO_3$ and solid solution of $PbTiO_3$-$PbZrO_3$ in a volume ratio of 55–60 of ferroelectric powder with 45–40 of flexible polymer material. The mixture is extruded to form a cable, which is then coated with conductive electrode such as by vapor deposition of metal, metallic foil, conductive rubber, etc., and polarized under the conditions of ordinary temperature, atmospheric pressure and voltage at 100–120 KV/cm.

Rubbers or synthetic resins having suitable elasticity and excellent processability are used as the material for the outer layer, which are urethane rubber, butadiene rubber, natural rubber, synthetic rubber, styrene-butadiene rubber, polyvinylidene fluoride (PVDF), nylon, polycarbonate, epoxy resin, polypropyrene, or the like.

These piezoelectric materials of polymers and polymer composites as mentioned above are used in the present invention because they have not only a greater mechanical strength compared to piezoelectric materials, but also excellent flexibility and processability. The excellent flexibility of these materials renders proper damping action preventing vibration of one string from interferring the vibration of adjacent strings, thereby facilitating the separation of each note, while the excellent processability enables one to easily mold and form a transducer which is long enough to contact with all of the plurality of strings.

It is also possible to prevent the rapid tone dimunition at high frequency range deriving from the flexibility of the piezoelectric transducer strip by increasing the stiffness of the piezoelectric transducer with the use of said elastomer of the hardness of not less than 80, or with the use of piezoelectric cable by plaiting (braiding) metal wires or winding metal wire so as to enable its outer electrode to press against the piezoelectric layer. Conceivable uses for piezoelectric transducer in accordance with the present invention are such electric string instruments as electric piano, guitars, mandolins, and violins.

The present invention is now explained reference being made to its embodiments, but it should be understood that these embodiments in now way limit the present invention.

FIG. 1 illustrates a piezoelectric transducer A according to the present invention, which comprises a long and flat outer layer 5 and a piezoelectric cable 1 having the outer diameter of 2.0 mm and buried therein. The piezoelectric cable 1 is provided with a piezoelectric layer 3 of 1.4 mm in diameter made of a piezoelectric material of polymer composite comprising chloroprene rubber, on the outer periphery of the center electrode 2 which is made of a thin twisted steel wire and 0.3 mm in diameter. The outer electrode 4 of 0.3 mm in thickness which is made of metallic film or conductive rubber is formed on the outer periphery of the said piezoelectric layer 3, whereby the cable is polarized. The piezoelectric cable can be produced by extruding piezoelectric material together with the center electrode 2 to form the piezoelectric layer 3 and by coating its outer periphery with the outer electrode. The materials for the piezoelectric layer 3 to be subjected to extrusion molding have the hardness of 40 to 70 measured by the Spring Hardness Test Method described in the Physical Testing Methods for Vulcanized Rubber of Japanese Industrial Standard (JIS K 6301), and the hardness in this embodiment is 60. The outer layer 5 is a strip having the thickness of 3 mm and width of 15 mm, and is made of hard urethane rubber of the hardness of 90 in this embodiment. The stiffness of the piezoelectric transducer A is markedly increased, as compared with the piezoelectric transducer having the outer layer of the hardness below 80, by increasing the hardness of the material for the outer layer.

Figure 2:
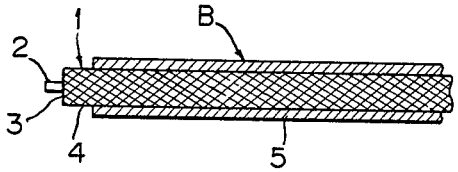
FIG. 2 is a longitudinal sectional view of an embodiment of the second invention of the application.

FIG. 2 shows a piezoelectric transducer B according to an embodiment of the second invention. The piezoelectric transducer B of this embodiment comprises identical elements as those of the transducer A of the first invention except that the outer electrode 4 comprises thin metal wires which are plaited (braided) in such a manner as to cause the electrode 4 to press against the piezoelectric layer 3, thereby increasing the stiffness of the piezoelectric transducer.

Figure 3:
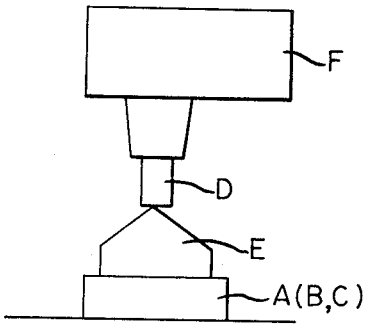
FIG. 3 is a diagram to show the method of output test for piezoelectric transducer.
Figure 4:
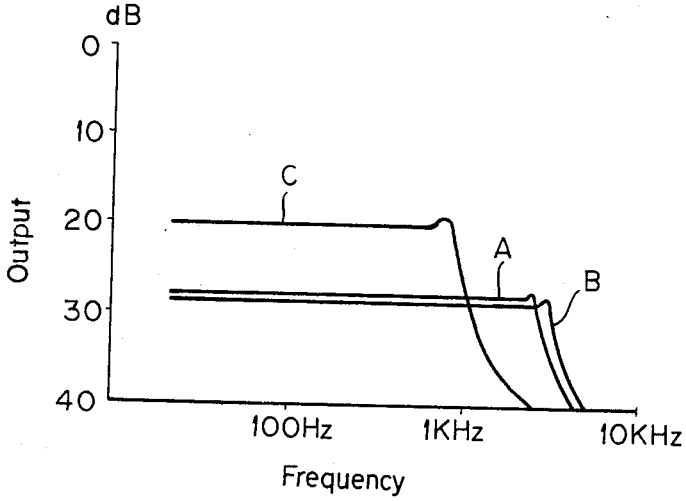
FIG. 4 is a graph illustrating the test results.

The piezoelectric transducers A and B of the above mentioned embodiments 1 and 2 and a piezoelectric transducer C which is identical to the piezoelectric transducer A except for its outer layer which comprises polyurethane or rubber hardness 70 are used for a piezoelectric pickup of an electric string instrument as shown in FIG. 3. FIG. 4 is a graph showing the output characteristics of the said pickup when the acceleration is maintained constant by a vibrator F via a shim E and the load D which applies a downward compression force identical to the external force to be applied by the tensile strength of the string and varying the frequency within the range of 20 Hz to 10 KHz.

From the graph of FIG. 4, one learns that the piezoelectric transducer A in accordance with the first invention of the present application is particularly excellent in its output characteristics at high frequency range compared with the conventional piezoelectric transducer C with a lower stiffness, and that the output characteristics at high frequency range of the piezoelectric transducer B in accordance with the second invention of the present application is excellent and further improved as its stiffness has been increased by making the outer layer harder and the piezoelectric cable harder than those of the piezoelectric transducer A.

The reason why the hardness of the outer layer material of the piezoelectric transducer of the first invention is maintained at not less than 80 measured by the said Spring Hardness Test Method for rubber is because, if the hardness is lower, then the stiffness of the piezoelectric transducer becomes less and there is not sufficient improvement in the output characteristics at high frequency range. Therefore, the hardness of the outer layer material is preferred to be within the range of 85–98. The thicker the outer layer is, the smaller the stiffness of the transducer becomes, and therefore the thicker the outer layer is, the more the output characteristics at high frequency range deteriorates when it is made of the material having the same hardness.

While we have described a case in accordance with the second embodiment in which the stiffness of the piezoelectric transducer is enhanced by increasing the stiffness of both the outer layer and the piezoelectric cable, it is also possible to increase the stiffness with the use of the piezoelectric cable of which stiffness is increased by pressing the outer electrode against the piezoelectric layer thereof while using a flexible material of the hardness of less than 80 for outer layer. Also, it is possible to obtain the outer electrode which presses against the piezoelectric layer by winding a metal wire in a spiral around the outer periphery of the piezoelectric layer.

The piezoelectric transducer according to the present invention may be so constructed that two or more piezoelectric cables are buried in the outer layer, whereby output can be produced from each cable.

Figure 5A:
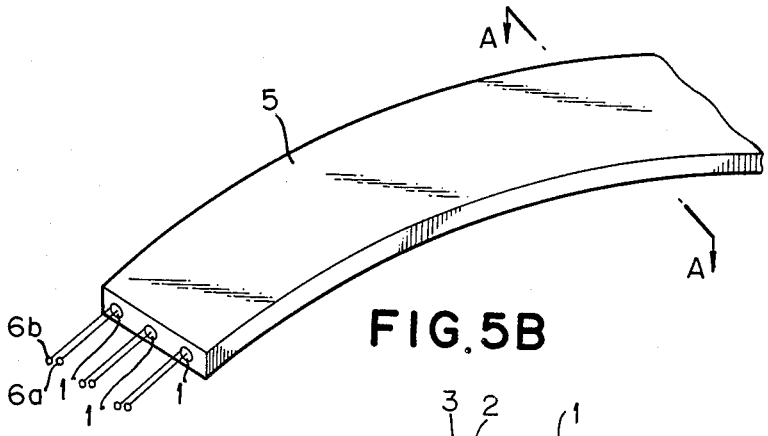
FIGS. 5A and 5B illustrate an embodiment of the present invention wherein two or more piezoelectric cables are buried in the outer layer.
Figure 5B:
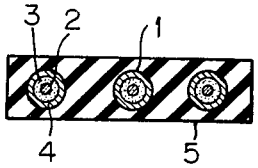

FIGS. 5A and 5B shows an embodiment of the present invention comprising the outer layer 5 which is long and flat in shape and made of rubber, resin or the like, and which, if necessary, is bent to a predetermined curvature, and a plurality of piezoelectric cables 1 buried in the said outer layer 5 in the longitudinal direction. The piezoelectric cable is polarized after forming around the outer periphery of the center electrode 2 made of a metal wire or the like, a piezoelectric layer 3 of piezoelectric polymer material, and further forming around the outer periphery of the said piezoelectric layer an outer electrode 4 made of a metal net or the like.

Figure 6A:
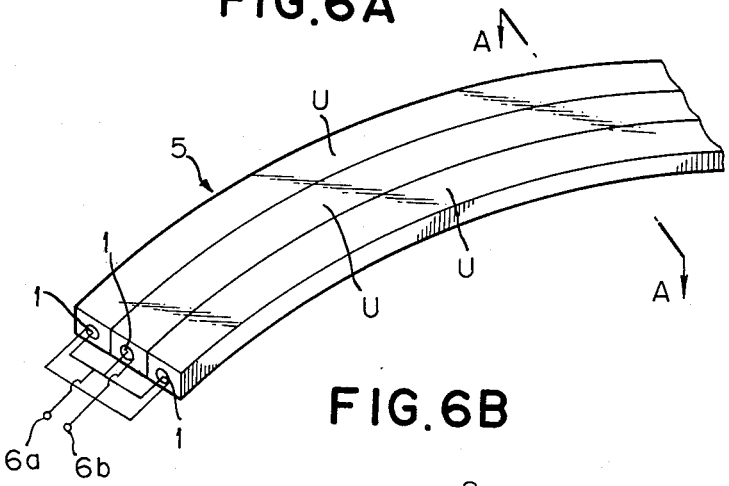
Figure 6B:
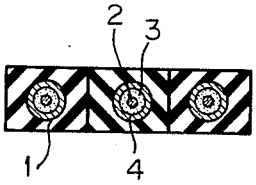

FIGS. 6A and 6B shows still another embodiment of the present invention in which the piezoelectric cable 1 of the identical construction as that of the piezoelectric cable 1 shown in FIGS. 5A and 5B is covered by the outer layer made of rubber, resin or the like to form one unit U, and a plurality of units in longitudinal alignment are integrally bound by adhesive or the like.

The configuration of the integrally bound units is the same as the one shown in FIGS. 5A and 5B.

In the embodiments described above, the center electrode 2 and the outer electrode 4 of each piezoelectric cable can be provided, as shown in FIGS. 5A and 5B, with signal extracting lead wires *6a*, *6b* respectively for independently extracting the electrical signals that are generated at each cable. Alternately, it is possible to electrically connect the cables in series or parallel (the drawing shows a parallel connection) and attach thereto common lead wires *6a*, *6b* so that the electrical signals generating at each cable can be extracted in pile.

Figure 7A:
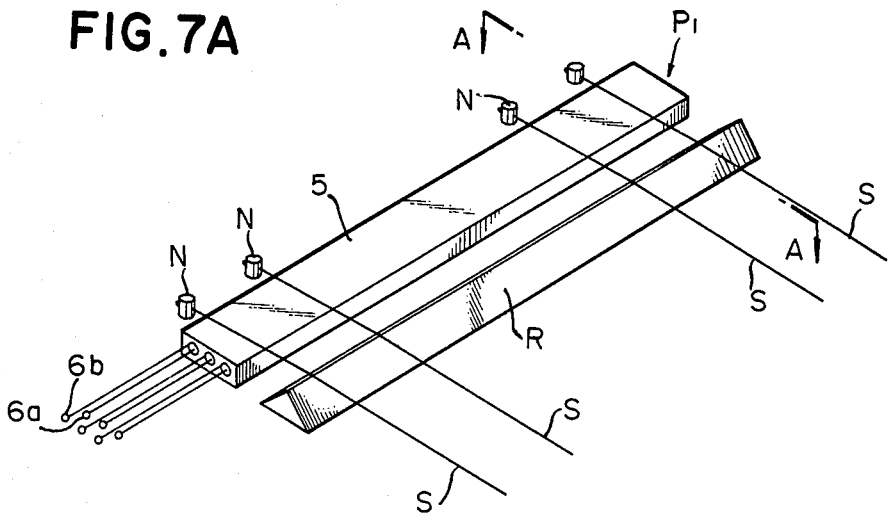
FIGS. 7A and 7B and 8A and 8B show the manner in which the piezoelectric transducer of the present invention is installed in an electrical string instrument.
Figure 7B:
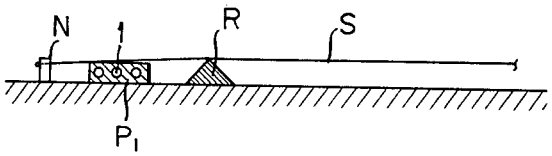
Figure 8A:
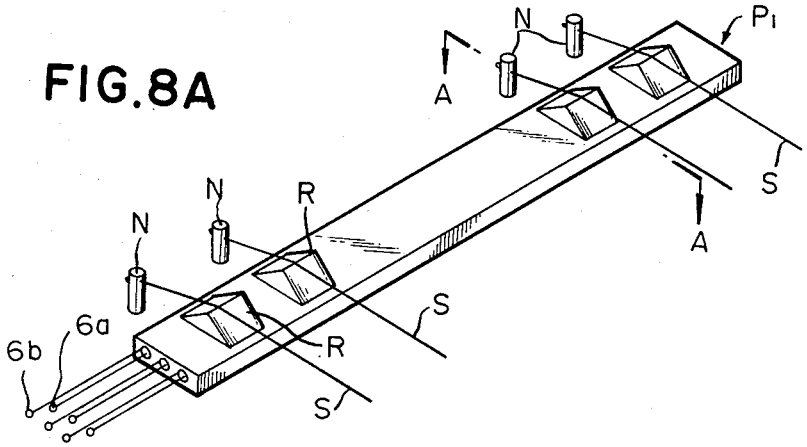
Figure 8B:
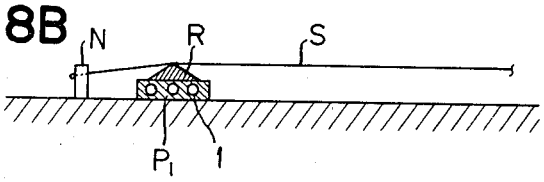

The transducer as described above is attached to an electrical string instrument, for example, as shown in FIGS. 7A and 7B, by installing the same perpendicular to the direction of the group of strings in a position located between one of the anchor pins N for stretching a plurality of strings and a bridge R provided adjacent to the anchor pins N in such a manner that the transducer comes in contact with all of the plurality of strings. As shown in FIGS. 8A and 8B, the transducer may be installed normal to the direction of the plurality of strings in a position adjacent to the anchor pins N for stretching the strings in such a manner that it comes in contact with all of the strings by means of shims R for the strings.

Figure 9A:
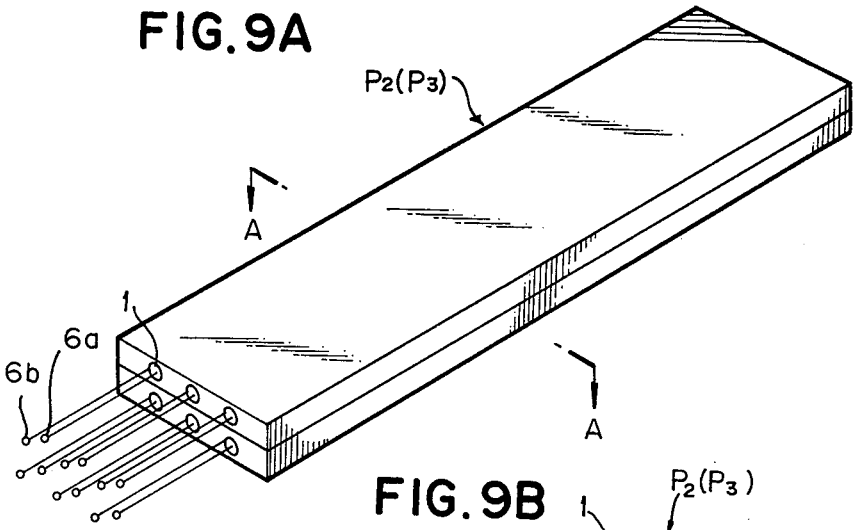
FIGS. 9A and 9B show a piezoelectric transducer of bimorphic structure obtained by laminating the transducers of the present invention.
Figure 9B:
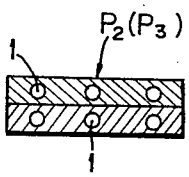

The mode of operation of the present invention will now be described, referring to FIGS. 8A and 8B. As the plurality of strings S are vibrated, the vibration stress is distributed via the shim R to the piezoelectric transducer P, which excites electrical signals proportionately to the vibration stress of the strings. The electrical signals are transmitted to an amplifier (not shown) by means of lead wires *6a*, *6b* which are connected to the electrodes 2 and 4. The amplified electrical signals are then sent to a speaker (not shown) to produce tonal outputs. As shown in FIGS. 9A and 9B, it is possible to use a transducer of bimorphic structure wherein two transducers shown in FIG. 1 are so laminated as to form an electrically parallel and mechanically serial arrangement.

Figure 10A:
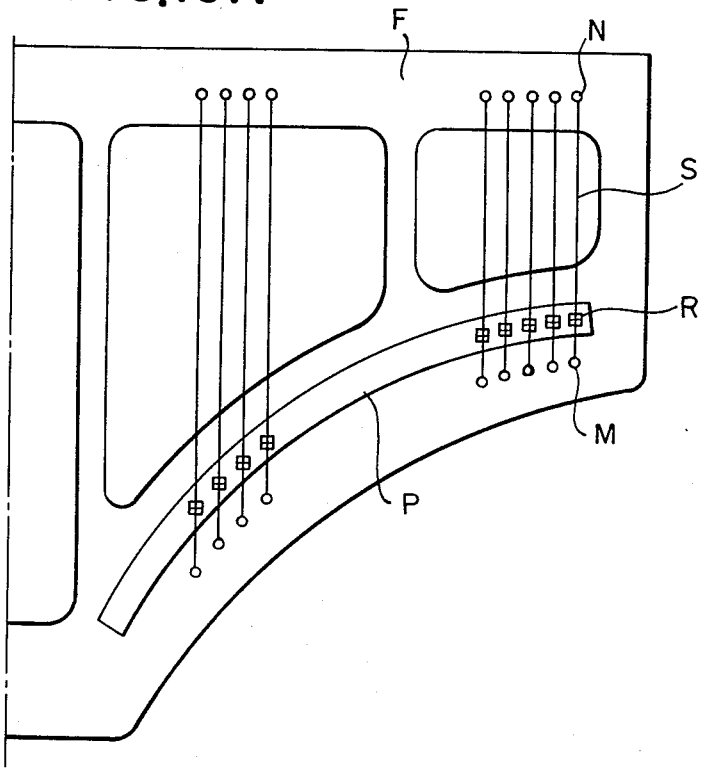
FIGS. 10A and 10B show an example of application of the piezoelectric transducer in accordance with the present invention when attached to an electropiano.
Figure 10B:
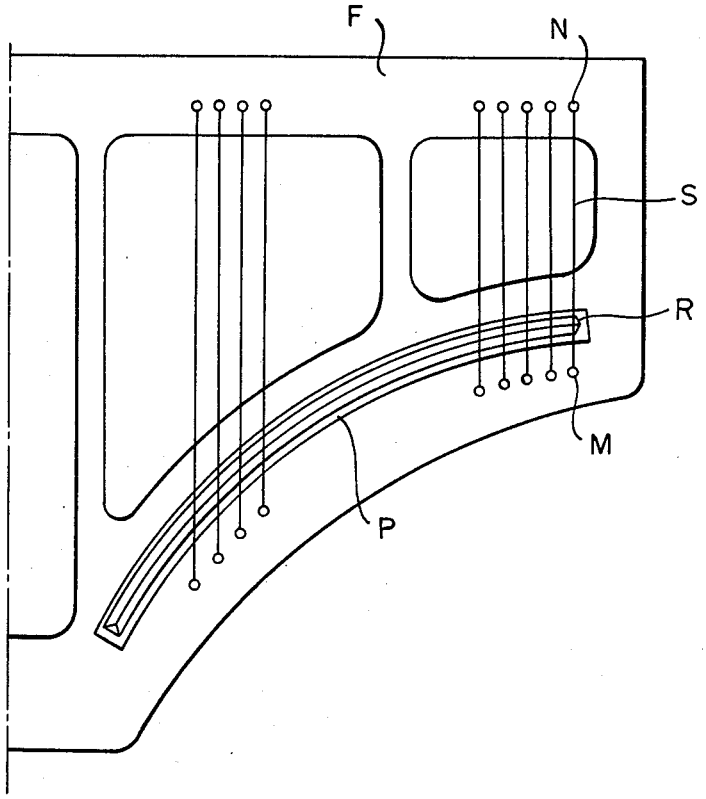

FIGS. 10A and 10B illustrate an example of application of the piezoelectric transducer of the present invention attached to an electropiano. The above mentioned transducer P is provided on the surface of the frame F for an electropiano at its base and extends the entire width thereof to straddle said plurality of strings S that are stretched between tuning pins N and anchor pins M, the said transducers being provided at the surface thereof with shims R to contact and engage with each of the strings. When one or more strings S are vibrated, the mechanical oscillations are transmitted to the piezoelectrical transducer P by way of the shims R, whereby electrical signals proportional to the oscillations of the strings are generated from each of the plurality of piezoelectric cables buried in the transducer.

As can be understood from the foregoing description, the piezoelectric transducer according to the first invention of this application is superior for use in electrical string instruments as it enables a higher output at high frequency range because of its greater stiffness obtained by the use of elastomer having the hardness of 80 or more as the material for the outer layer. A higher output at high frequency range can also be obtained by the piezoelectric transducer according to the second invention as its stiffness is enhanced by increasing the stiffness of piezoelectric cable by means of the outer electrode. Furthermore, the frequency characteristics at high frequency range can be improved by increasing the stiffness of both the outer layer and the piezoelectric cable, whereby increasing the stiffness of the piezoelectric transducer.

The piezoelectric transducer comprising a long and flat outer layer in which are buried a plurality of piezoelectric cables in longitudinal direction is advantageous in that it can be commonly used for plurality of strings, and that the mechanical oscillations of the strings can be converted into a plurality of electrical vibrations by burying a plurality of cables. This provides a greater practical value as compared with the conventional transducers which could not but convert only one electrical signal at a time. The transducer according to the present invention is not only simple in structure and extremely easy to install, as compared with the conventional ones that are attached one by one for every string, but it requires no complicated wiring. Still further, since the piezoelectric transducer of the present invention itself has excellent flexibility and functions as a damper so that the acoustic insulator which has heretofore been considered indispensable can be omitted, it reduces the production cost to a great extent and provides inexpensive electrical instruments in the market.

We claim:

1. A piezoelectric transducer for electrical string instruments comprising a long and flat outer layer of flexible material, a flexible piezoelectric cable being buried therein and having a center electrode, a piezoelectric layer formed on the outer periphery of the said electrode and an outer electrode formed on the outer periphery of the said piezoelectric layer, the material for the said outer layer having a hardness in the range from 85 to 98 as measured by Spring Type Hardness Test according to JIS K 6301 (1975), thereby increasing the stiffness of the piezoelectric transducer.

2. A piezoelectric transducer for electrical string instruments according to claim 1, wherein the outer electrode is formed by plaiting of metal wires so as to be pressed against the piezoelectric layer, thereby further increasing the stiffness of the piezoelectric transducer.

3. A piezoelectric transducer for electrical string instruments according to claim 1, wherein the outer electrode is formed by winding of a wire so as to be pressed against the piezoelectric layer, thereby further increasing the stiffness of the piezoelectric transducer.

4. The piezoelectric transducer for electrical string instruments as claimed in claim 1 wherein the material for the outer layer is urethane rubber.

5. The piezoelectric transducer for electrical string instruments as claimed in claim 1 wherein the material for the outer layer is a thermoplastic polymer material.

6. The piezoelectric transducer for electrical string instruments as claimed in claim 1 wherein the piezoelectric layer is made of a polymer piezoelectric material.

7. The piezoelectric transducer for electrical string instruments as claimed in claim 1 wherein the piezoelectric layer is made of piezoelectric material of polymer composite comprising a flexible polymer material and ferroelectric powder.

8. The piezoelectric transducer for electrical string instruments as claimed in claim 1 wherein the piezoelectric layer is made of piezoelectric material of polymer composite comprising chloroprene rubber and ferroelectric powder.

9. The piezoelectric transducer for electrical string instruments as claimed in claim 1 wherein a plurality of flexible piezoelectric cables are buried in the long and flat outer layer of flexible material in their longitudinal direction.

10. The piezoelectric transducer for electrical string instruments as claimed in claim 7 wherein a plurality of flexible piezoelectric cables are buried in the long and flat outer layer of flexible material in the longitudinal direction.

11. A pickup means for electrical string instruments which is so constructed as to convert the oscillation of a plurality of strings into electrical signals by a piezoelectric transducer, said piezoelectric transducer comprising a long and flat outer layer of flexible material, a flexible piezoelectric cable being buried therein and having a center electrode, a piezoelectric layer formed on the outer periphery of the said electrode and an outer electrode formed on the outer periphery of the said piezoelectric layer, the material for the said outer layer having a hardness in the range from 85 to 98 as measured by Spring Type Hardness Test according to JIS K 6301 (1975), thereby increasing the stiffness of the piezoelectric transducer.

12. The pickup means for electrical string instruments as claimed in claim 11 wherein the said piezoelectric transducer is in contact with the plurality of strings.

13. The pickup means for electrical string instruments as claimed in claim 11 wherein the said piezoelectric transducer is in contact with the plurality of strings by means of shim member for the strings.

* * * * *